US007703876B2

(12) United States Patent
Ebuchi

(10) Patent No.: US 7,703,876 B2
(45) Date of Patent: Apr. 27, 2010

(54) CONTROL SYSTEM FOR PRINTING APPARATUS AND INFORMATION PROCESSING APPARATUS

(75) Inventor: Kazuhisa Ebuchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 671 days.

(21) Appl. No.: 11/676,105

(22) Filed: Feb. 16, 2007

(65) Prior Publication Data

US 2007/0196154 A1 Aug. 23, 2007

(30) Foreign Application Priority Data

Feb. 20, 2006 (JP) ..... 2006-043158

(51) Int. Cl.
*B41J 2/165* (2006.01)

(52) U.S. Cl. ..... 347/22; 347/23; 347/19

(58) Field of Classification Search ..... 347/5, 347/9, 14, 19, 22, 23
See application file for complete search history.

(56) References Cited

U.S. PATENT DOCUMENTS 6,682,164 B2 * 1/2004 Vega et al. ..... 347/22
2006/0109298 A1 * 5/2006 Lee et al. ..... 347/22

FOREIGN PATENT DOCUMENTS

JP 2003-118145 4/2003

* cited by examiner

*Primary Examiner*—Lam S Nguyen
(74) *Attorney, Agent, or Firm*—Fitzpatrick, Cella, Harper & Scinto

(57) ABSTRACT

An appropriate maintenance such as appropriate registration adjustment can be executed even if a status for the maintenance cannot be acquired from a printing apparatus. Specifically, if a status cannot be acquired from the printer, a printer driver refers to a history of number of past instructions for registration adjustment stored in a host computer to determine whether simplified registration adjustment or detailed registration adjustment is to be executed. If the printer driver does not detect any record of executed registration adjustment, that is, if the printer driver detects that no registration adjustment has been executed, then it determines that the simplified registration adjustment is to be executed. If the printer driver detects any record of executed registration adjustment, it determines that the detailed registration adjustment is to be executed. Thus, the invention enables the correct guidance and the corresponding appropriate registration adjustment even if the status cannot be acquired.

7 Claims, 12 Drawing Sheets

FORWARD
SCAN PRINTING

BACKWARD
SCAN PRINTING

TEST PATTERN

FIRST SHEET

SECOND SHEET

CONTROL SYSTEM FOR PRINTING APPARATUS AND INFORMATION PROCESSING APPARATUS

BACKGROUND OF THE INVENTION

1. Field of the Invention

The present invention relates to methods for controlling maintenance of printing apparatuses and information processing apparatuses. Specifically, the present invention relates to a method and apparatus for controlling execution of maintenance for a printing apparatus such as a registration adjustment which adjusts a deviation of print position in the printing apparatus.

2. Description of the Related Art

A registration adjustment is known as a typical maintenance in printing apparatuses such as ink jet printers. With what is called a serial type of an ink jet printer that executes printing by scanning a print head over print media such as sheets, when printing involves both forward and backward scans of the print head, ink landing position may deviate between the forward scan and the backward scan. To prevent this, the registration adjustment is executed by detecting the deviation and on the basis of the detection, adjusting ejection timings of the print head and the like.

FIGS. 1A to 1C are diagrams illustrating a registration adjustment. FIG. 1C shows an entire test pattern used for the registration adjustment. The (data on) test pattern is divided into pieces. A forward scan is executed to print a pattern having print areas located at fixed intervals in a scanning direction as shown in FIG. 1A. Further, a backward scan is executed to print a pattern complementary to the forward pattern in the same scan area as that for the forward scan, as shown in FIG. 1B. Then, the ejection timing for at least one of the forward and backward scans is changed. The resulting timings are used to print the same forward and backward patterns in a different area. This results in patterns corresponding to the respective changed timings, such as patterns A to E in FIG. 2. Then, a user selects one of these patterns which is most similar to the pattern shown in FIG. 1C and inputs information on the selected pattern. In the example shown in FIG. 2, the pattern C is selected. Selection of the pattern C, that is, selection and inputting of the ejection timing for this pattern, sets a registration adjustment value that minimizes the deviation of landing positions of ink droplets in bidirectional printing. It should be noted that for each of a plurality of nozzles in the print head, the registration adjustment may also be executed.

The registration adjustment as described above is desirably executed on all the nozzles of all the ink colors for the print head that are used in the ink jet printer. However, recent printers use a very large number of nozzles and ink colors, and therefore registration adjustment requires a very long time in the case that the adjustment is executed for all nozzles and ink colors. Further, certain ink colors provide insufficient visibility, making the adjustment difficult. Thus, the desirable mode of a registration adjustment is such that a detailed registration adjustment such as a registration adjustment of all the nozzles for all the ink colors is only executed as required.

On the other hand, the deviation of ink landing position of the print head may occur during a manufacture process for an unavoidable reason involving the differences among individual print heads or while the print head is in use, owing to a change in ejection condition (aged variation). For the deviation occurring during manufacture, individual differences among production lines are still occurring, but the differences among the nozzles in the same print head are relatively small because of improved manufacturing accuracy. Consequently, the user's first operation of a printer following purchase does not require a detailed registration adjustment which executes a registration adjustment on all the nozzles for all the ink colors. In this case, a simplified registration adjustment is sufficient which executes a registration adjustment only on some of the ink colors and some of the nozzles. Then, the detailed registration adjustment is executed when the ejection condition seems to have changed after a number of operations of the printer.

In these circumstances about the registration adjustment, in conventional registration adjustment control modes, the user is provided with a configuration for instructing the execution of a registration adjustment without distinction between the simplified and detailed versions so that upon receiving this simple adjustment instruction, the printer determines whether or not this is the first time to execute a registration adjustment and correspondingly determines which registration adjustment is to be executed. Specifically, upon receiving the user's registration adjustment instruction via a host computer such as a personal computer (PC), the printer reads the ID of the mounted print head or data from a memory in the printer. The printer thus determines whether or not the print head has been subjected to a registration adjustment before to correspondingly determine whether the simplified registration adjustment or the detailed registration adjustment is to be executed.

As similar method that executes certain adjustment or processing on the basis of the printer's own determinations, a method is known which determines execution timings for a print head ejection recovery process to be executed, on the basis of the accumulated number of ink droplets ejected and the analysis of print data to be printed (Japanese Patent Application Laid-Open No. 2003-118145). This enables timings for an ejection recovery process to be automatically set depending on a print amount or the like.

However, the registration adjustment involves operations which require inputting of the required type and number of sheets, how to use adjustment patterns, and adjustment values, and is complicated compared to other adjustments or processes. Thus, in many cases, a user interface in the host computer such as the PC desirably shows a user what operations the user should perform for the registration adjustment. For example, in response to an instruction from the user instructing the execution of a registration adjustment, the host computer provides guidance for preparation for the registration adjustment, for how to check the patterns, and for inputting of adjustment values. The guidance is provided by software such as a printer driver or maintenance utility.

To allow the host computer to provide proper guidance, it is desirable that the host computer previously determines whether the required registration adjustment for the printer is of the detailed version or the simplified version. As a configuration achieving this, some printers return, upon receiving the instruction to execute the a registration adjustment, an informative status indicating which of the simplified and detailed registration adjustments the printer is to execute. The printer driver or maintenance utility then presents appropriate guidance or a setting value input screen in accordance with the returned status.

However, when the printer is powered off or temporarily remains busy, the host computer cannot obtain the printer status when it is needed. Further, for example, the Microsoft's operating system Windows (registered trade mark) makes it possible to set the function of bidirectional communication between the PC and the printer to be disabled. Thus, if the function is turned off by the user for any reason, the host computer cannot acquire the printer status. Unfortunately, in this case, the appropriate guidance for the registration adjustment cannot be presented.

SUMMARY OF THE INVENTION

An object of the present invention is to provide a method for controlling maintenance of a printing apparatus and an information processing apparatus, which enable proper maintenance such as proper registration adjustment to be executed even if a status for the maintenance cannot be acquired from a printing apparatus.

In a first aspect of the present invention, there is provided a print control system capable of executing one of a plurality of maintenances for a printing apparatus, which have different maintenance levels and include at least a maintenance related to an adjustment of print positions by a print head in the printing apparatus, in accordance with information on an amount of a predetermined operation in the printing apparatus, the information being held by an information processing apparatus or a printing apparatus, said system comprising:

holding means for holding the information on an amount of the predetermined operation, said holding means being located in the information processing apparatus or in the printing apparatus; a user interface; acquiring means for acquiring the information on an amount of the predetermined operation from said holding means; and means for showing guidance for executing one of the plurality of maintenances on said user interface, based on the acquired information on an amount of the predetermined operation.

In a second aspect of the present invention, there is provided an information processing apparatus causing a printing apparatus that is capable of one of a plurality of maintenances for the printing apparatus, which have different maintenance levels, to execute the maintenance, in accordance with information on an amount of a predetermined operation in the printing apparatus, the information being held by an information processing apparatus or a printing apparatus, said information processing apparatus comprising: a user interface;

acquiring means for acquiring the information on an amount of the predetermined operation from holding means for holding the information on an amount of the predetermined operation, said holding means being located in the information processing apparatus or in the printing apparatus; and execution means for showing guidance for executing a first maintenance including at least a maintenance related to an adjustment of print positions by a print head in the printing apparatus or a second maintenance, on said user interface, based on the acquired information on an amount of the predetermined operation, and causing the printing apparatus to execute the maintenance.

In a third aspect of the present invention, there is provided a program that is read by a computer to cause the computer to function as an information processing apparatus causing a printing apparatus that is capable of one of a plurality of maintenances for the printing apparatus, which have different maintenance levels and include at least a maintenance related to an adjustment of print positions by a print head in the printing apparatus, to execute the maintenance, in accordance with information on an amount of a predetermined operation in the printing apparatus, the information being held by the computer or a printing apparatus, said function comprising: a user interface; acquiring means for acquiring the information on an amount of the predetermined operation from holding means for holding the information on an amount of the predetermined operation, said holding means being located in the computer or in the printing apparatus; and execution means for showing guidance for executing one of the plurality of maintenances on said user interface, based on the acquired information on an amount of the predetermined operation, and causing the printing apparatus to execute the maintenance.

According to the above configuration, the printing apparatus can be properly maintained regardless of whether or not status information on the maintenance of a printing apparatus can be acquired from the printing apparatus.

Further features of the present invention will become apparent from the following description of exemplary embodiments with reference to the attached drawings.

DESCRIPTION OF THE EMBODIMENTS

Embodiments of the present invention will be described below in detail with reference to the drawings.

First Embodiment

Figure 1A:
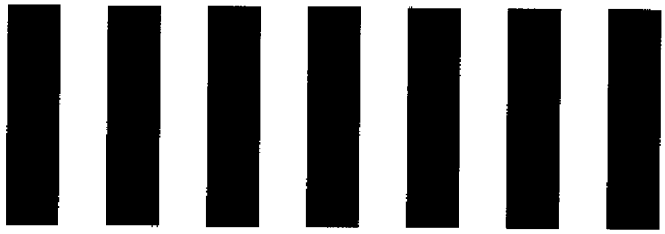
FIGS. 1A to 1C are diagrams illustrating a test pattern for a registration adjustment.
Figure 1B:
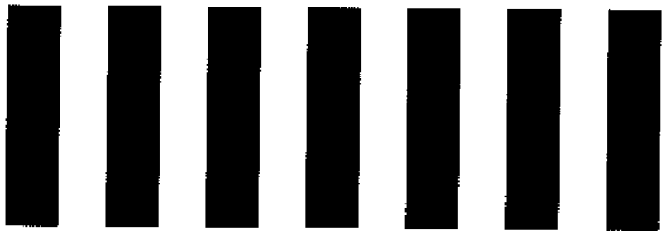
Figure 1C:
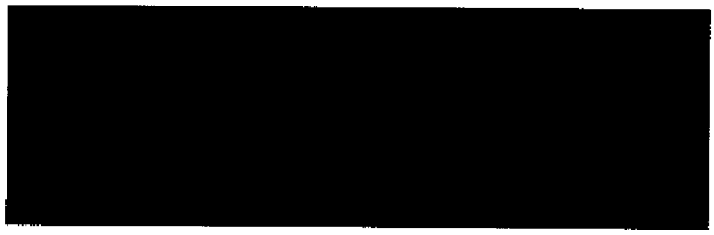
Figure 2:
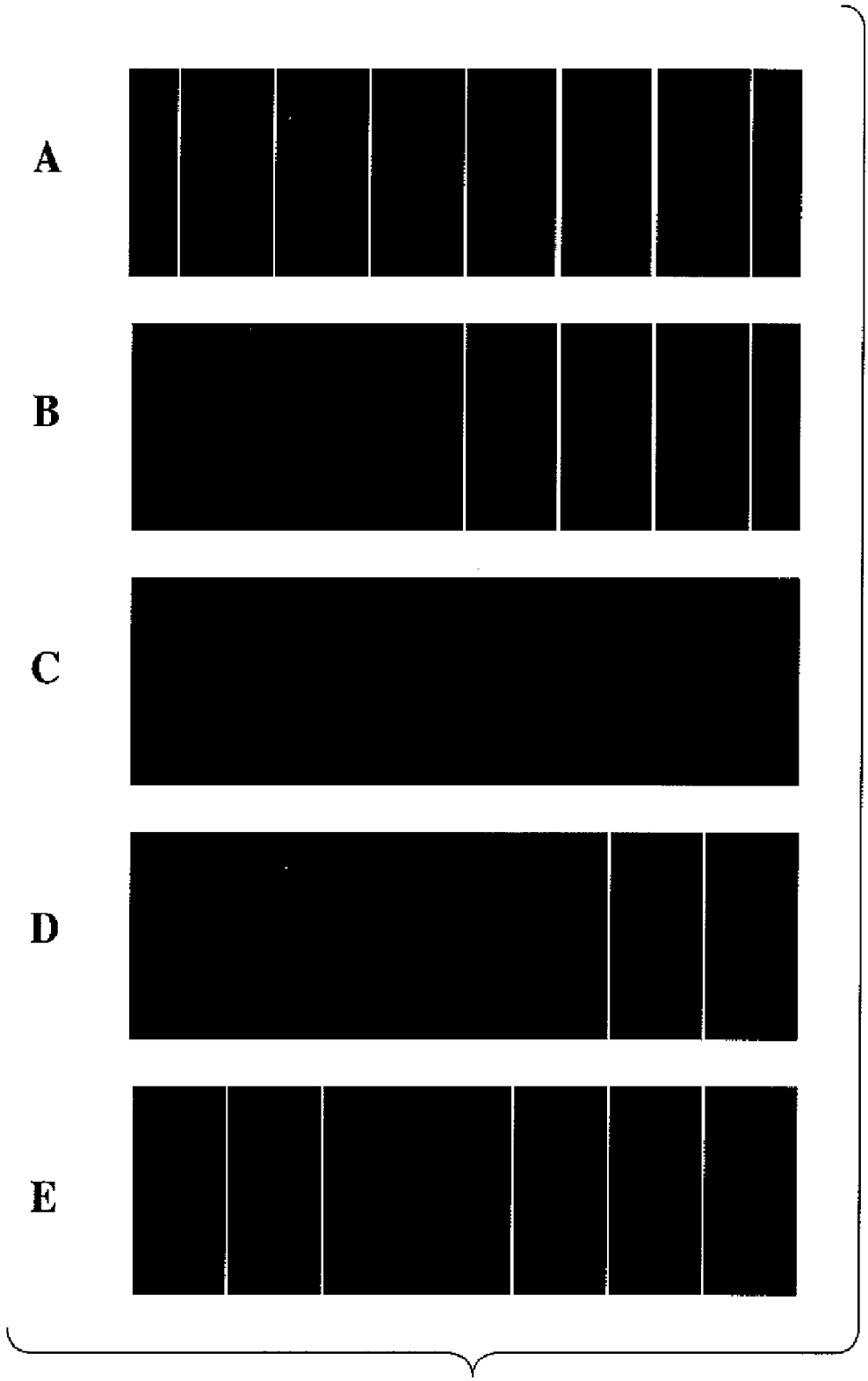
FIG. 2 is a diagram illustrating the output result of the test pattern for the registration adjustment.
Figure 3:
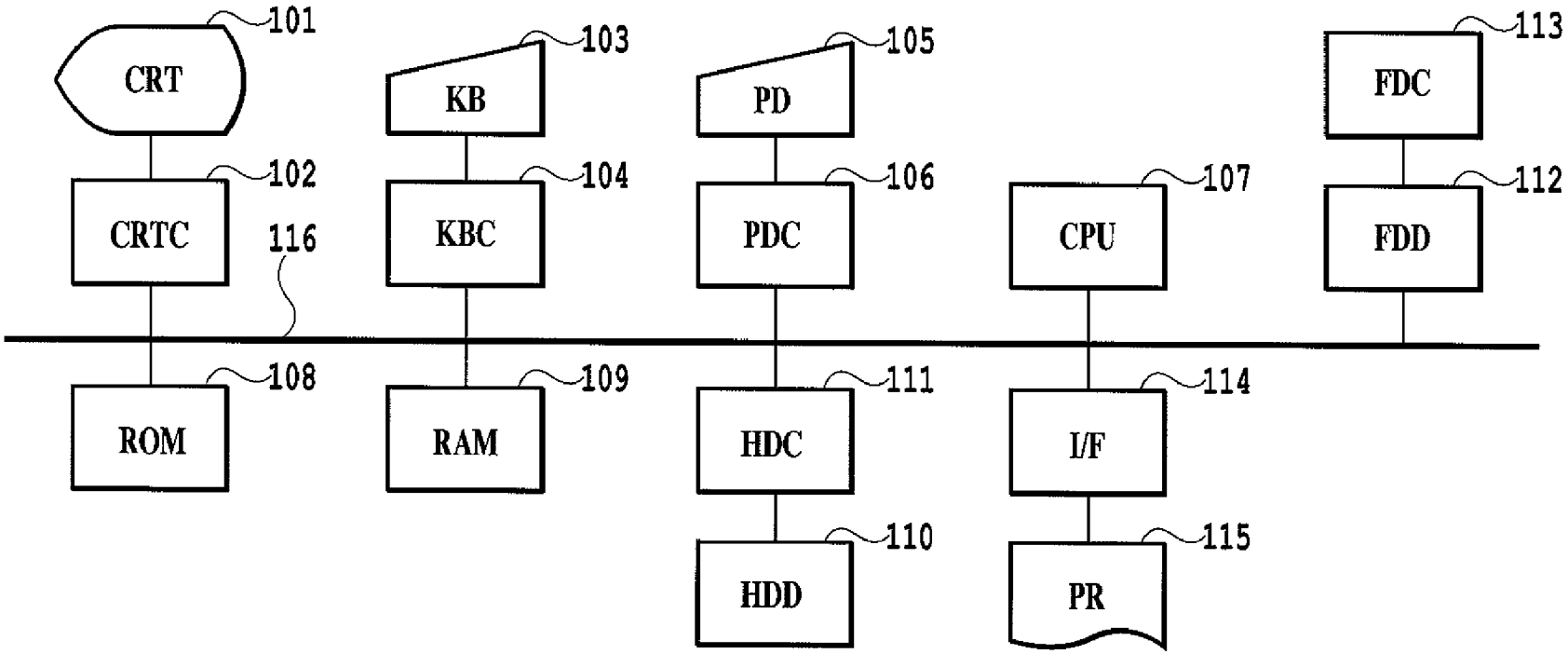
FIG. 3 is a block diagram showing the hardware configuration of a host computer in a printing system in accordance with an embodiment of the present invention.

FIG. 3 is a block diagram showing the hardware configuration of a host computer serving as an information processing apparatus in accordance with an embodiment of the present invention. In this figure, reference numeral 101 denotes a CRT display device that displays print setting dialogs provided by a printer driver and guidance for maintenance such as registration adjustment described below. Reference numeral 102 denotes a CRTC, that is, a controller for the display device. Reference numerals 103 and 104 denote a data input device such as a keyboard and a keyboard controller, respectively. Reference numerals 105 and 106 denote a coordinate input device such as a pointing device and a pointing device controller, respectively. Reference numeral 107 denotes a CPU responsible for controlling the whole apparatus. Reference numeral 108 denotes a ROM that stores a boot program and the like. Reference numeral 109 denotes a RAM which stores an OS, application programs, and a printer driver program and which is also utilized as a work area. Reference numeral 110 denotes a hard disk device which stores the OS, application programs, printer driver program, and font data and which temporarily stores spool files and the like. Reference numeral 111 denotes a hard disk controller. Reference numerals 112 and 113 denote a floppy (registered trade mark) disk device serving as a driving device for portable storage media, and a floppy (registered trade mark) disk controller, respectively. Reference numeral 114 denotes an interface connected to an ink jet printer 115 via an interface cable. Reference numeral 116 denotes a bus that connects the devices together.

The host computer configured as described above and serving as an information processing apparatus is powered on to start the CPU 107 in accordance with the boot program stored in the ROM 108. The CPU 107 loads the OS from the hard disk device 110 and waits for the user to perform an operation. When the user then operates the KB 103 or PD 105 to instruct the printer according to the application to execute printing or change print settings for the print driver, the printer driver program stored in the hard disk device 110 is loaded into the RAM 109, which then executes the program. The loading may be set so as to be automatically started.

Figure 4:
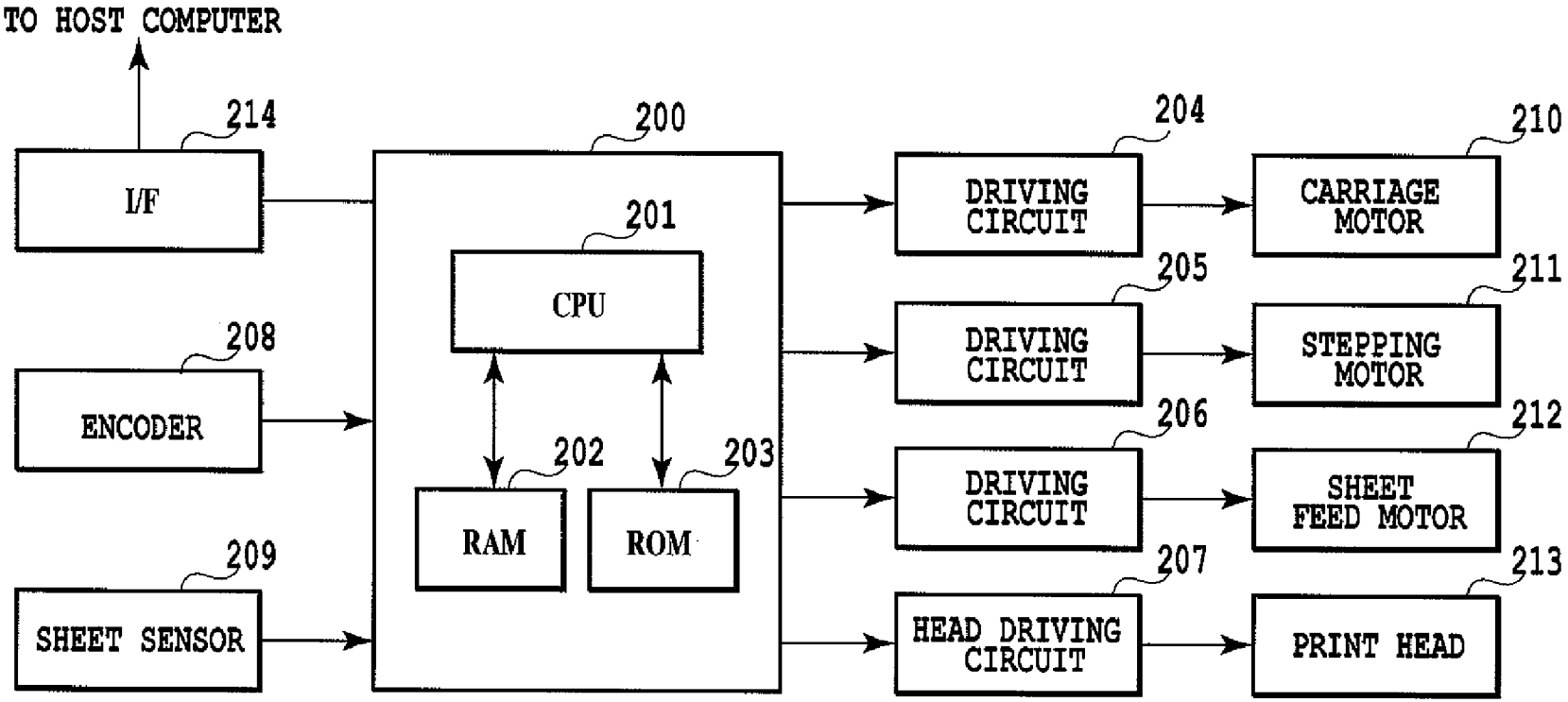
FIG. 4 is a block diagram showing the hardware configuration of a printer in the printing system.

FIG. 4 is a block diagram showing the detailed configuration of the printer 115 as a form of printing apparatus. In FIG. 4, reference numeral 200 denotes a control section that controls driving sections of the ink jet printer of the present embodiment. The control section includes a CPU 201 that executes processes such as various calculations, determinations, or control. The control section further includes a ROM 203 that stores programs to be executed by the CPU 201 and a RAM 202 which temporarily stores input data and which functions as a work area for calculation processes executed by the CPU 201. The control section 200 connects to a driving circuit 204 for a carriage motor 210 and a driving circuit 205 for a stepping motor 211 that drives a conveying roller. The control section 200 also connects to a driving circuit 206 for a sheet feed motor 212, a head driving circuit 207 that drives print elements (heaters) provided in nozzles in a print head 213, and the like. The control section 200 further connects to an interface (I/F) 214 that transmits and receives signals to and from the host computer, an encoder 208 that detects the position of a carriage, a sheet sensor 209, and the like. Thus, on the basis of signals input via the above components, the CPU 201 of the control section 200 performs printing operations as well as calculations, control, and determinations for a registration adjustment described below.

Registration adjustment values are stored in the RAM 202. The RAM 202 further stores the number of registration adjustments executed on the mounted print head 213, that is, a history, in association with the ID of the print head. The RAM 202 also stores the number of normal printing operations performed. On the other hand, in response to an instruction from the host computer instructing the execution of registration adjustment, the CPU 201 determines the type of registration adjustment to be executed in accordance with the history of registration adjustment stored in the RAM 202 to execute the corresponding one of a plurality of registration adjustment programs stored in the ROM 203. When the host apparatus not only instructs the CPU 201 to execute registration adjustment but also instructs the CPU 201 on the type of the registration adjustment, the CPU 201 executes the instructed type of registration adjustment. Further, when the CPU 201 is instructed by the host computer, via the interface (I/F) 214, on the type of the next registration adjustment to be executed, it returns a response status to the host computer indicating which of the plurality of registration adjustment programs is to be executed.

Figure 5:
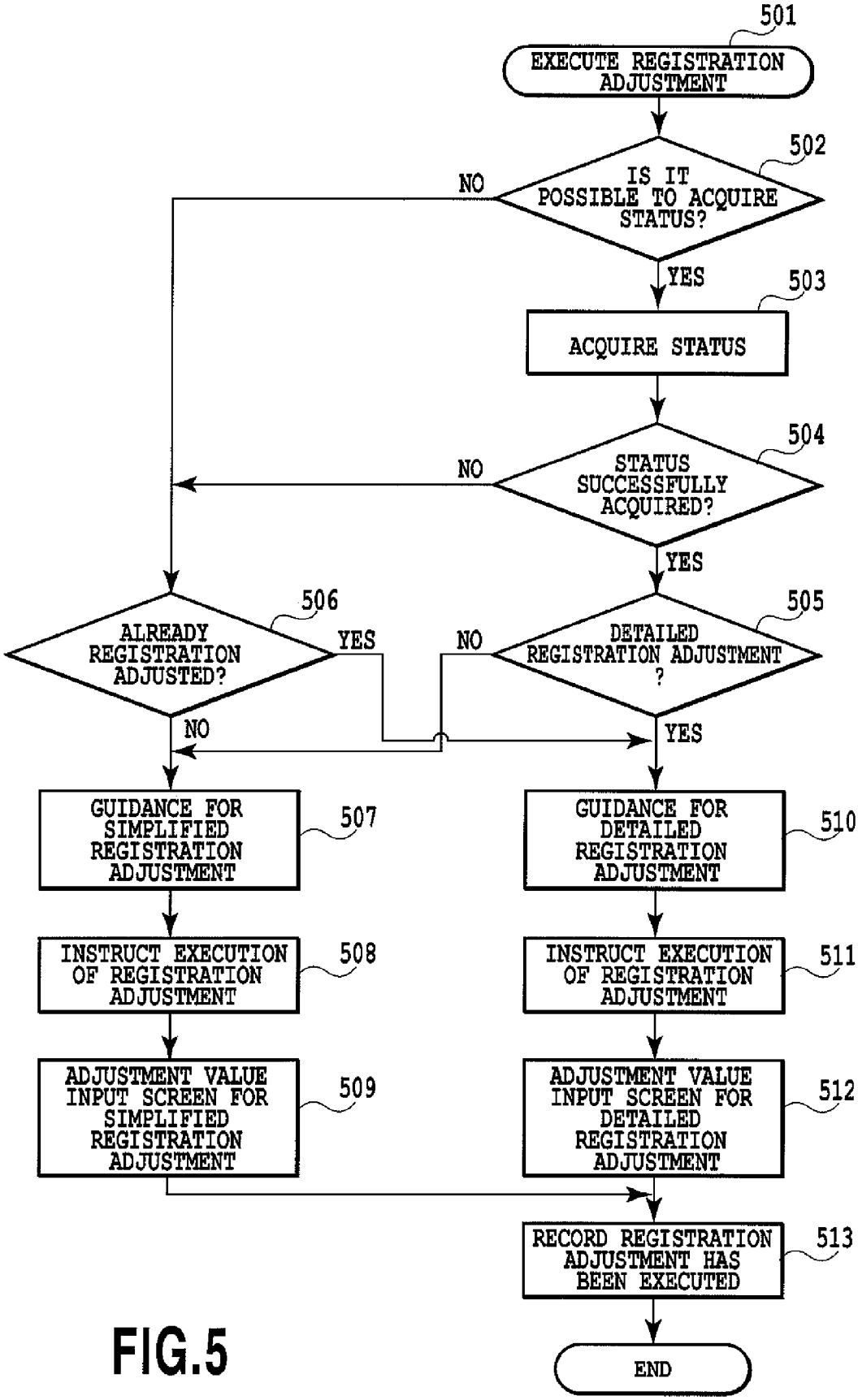
FIG. 5 is a flowchart showing a process executed by a printer driver in accordance with a first embodiment of the present invention.

FIG. 5 is a flowchart showing a process related to a registration adjustment (an adjustment of a print position) executed by the printer driver in the host computer in accordance with a first embodiment of the present invention.

The user instructs the execution of registration adjustment and then the process start at step 501. First, it is determined in step 502 whether or not a status can be acquired. If the bidirectional communication function is disabled or the connection with the printer is in an offline condition, it is determined that the status cannot be acquired and the process proceeds to step 506. On the other hand, if it is determined that the status can be acquired, the printer status is acquired in step 503.

In the present embodiment, the printer status is based on the number of registration adjustments executed on the mounted print head, that is, a history of the registration adjustment. If the history shows that at least one registration adjustment has been executed past, the status is what indicates the next registration adjustment to be executed is a detailed version. If the history does not show that any registration adjustment has been executed past, the status is what indicates the next registration adjustment to be executed is a simplified version. The basis for the status is not limited to the history of registration adjustment. For example, the basis for the status may be what indicates an amount corresponding to the past use of the print head, such as the total amount of printing (ejection) achieved by the mounted print head.

In step 504, it is determined whether or not the status has successfully acquired. If the status fails to be acquired, the process proceeds to step 506. If the status is acquired, it is determined in step 505 whether the registration adjustment to be executed is the detailed version or simplified version, on the basis of the status information.

Figure 6:
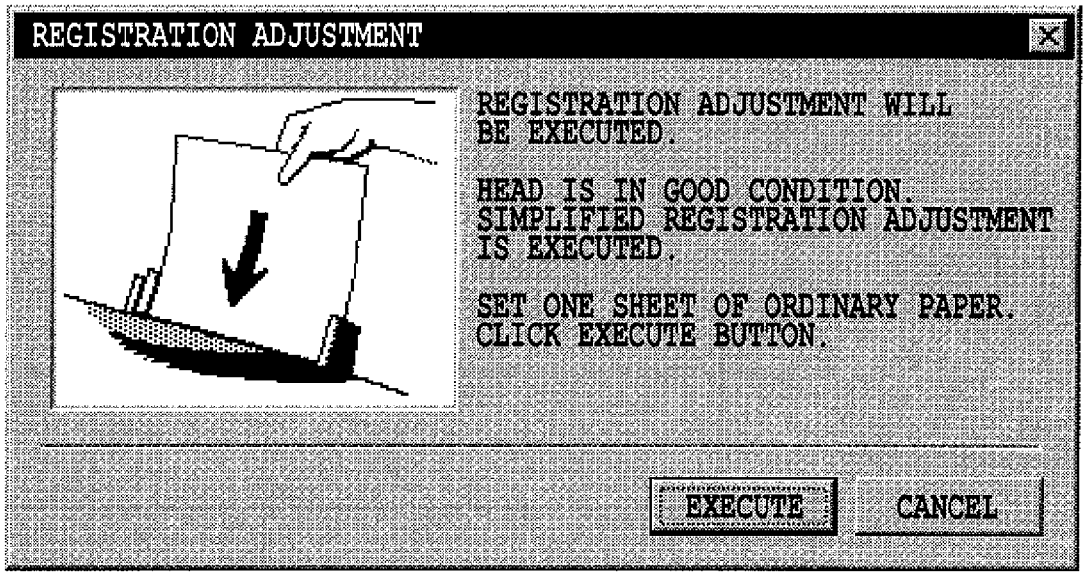
FIG. 6 is a diagram showing a display example of a simplified registration adjustment guidance in accordance with an embodiment of the present invention.
Figure 7:
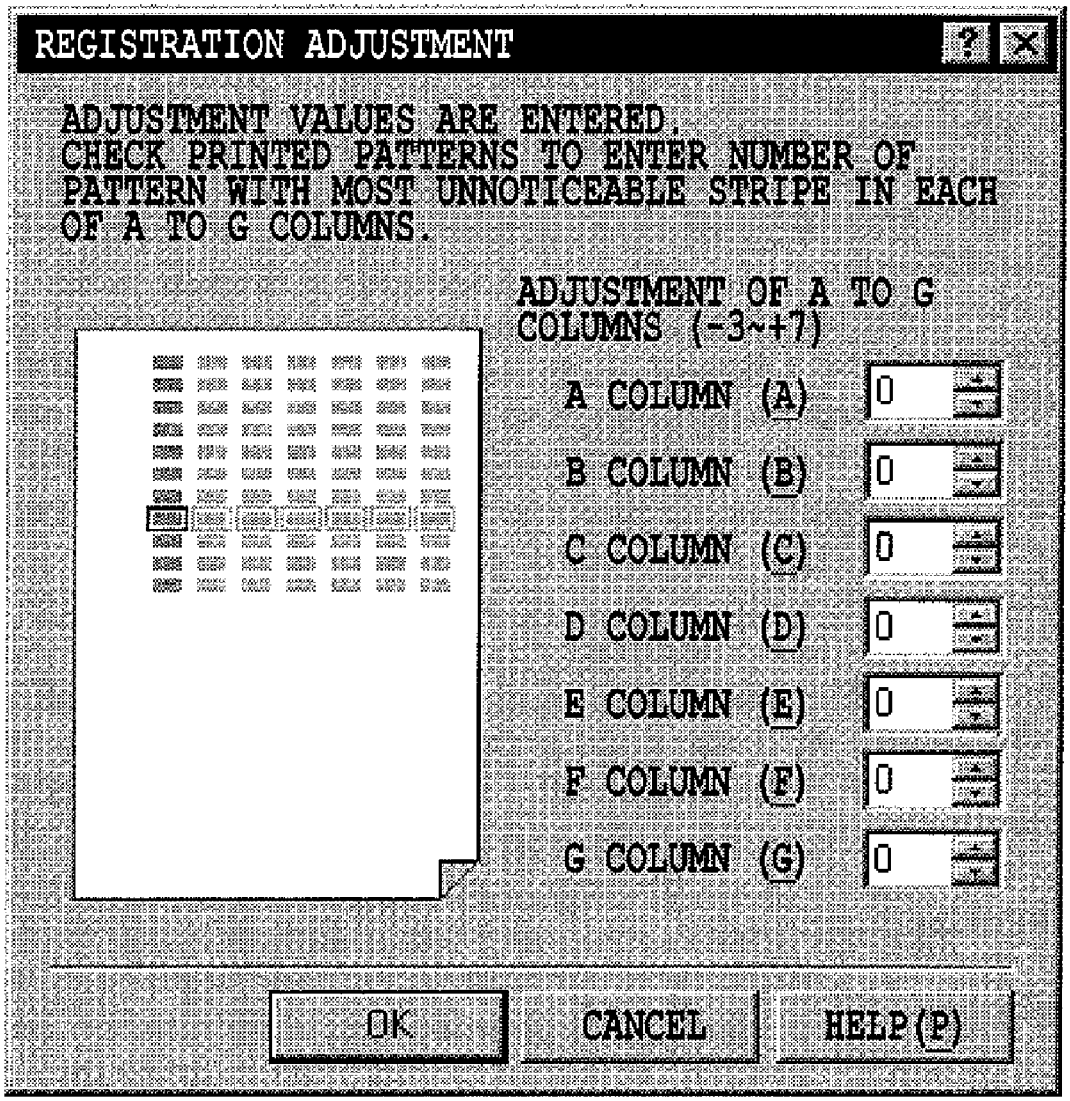
FIG. 7 is a diagram showing a display example of an adjustment value inputting screen for a simplified registration adjustment in accordance with an embodiment of the present invention.

If the simplified registration adjustment is to be executed, then in step 507, a simplified registration adjustment guidance shown in FIG. 6 is displayed to show the user the type and number of sheets required for the simplified registration adjustment. When the user instructs the execution of the registration adjustment via the user interface in the displayed guidance (S507), the printer driver issues a command for execution of registration adjustment to the printer in step 508 to cause the printer to print a registration adjustment pattern. Subsequently, in step 509, an adjustment value input screen for the printed adjustment patterns is displayed as shown in FIG. 7. The printer driver then accepts, via this displayed user interface, adjustment values input by the user and transmits the input values to the printer. As shown in FIG. 6, in the present embodiment, the guidance shows that the simplified registration adjustment requires printing on only one sheet of ordinary paper. Only one adjustment value input screen is correspondingly displayed as shown in FIG. 7.

Figure 8:
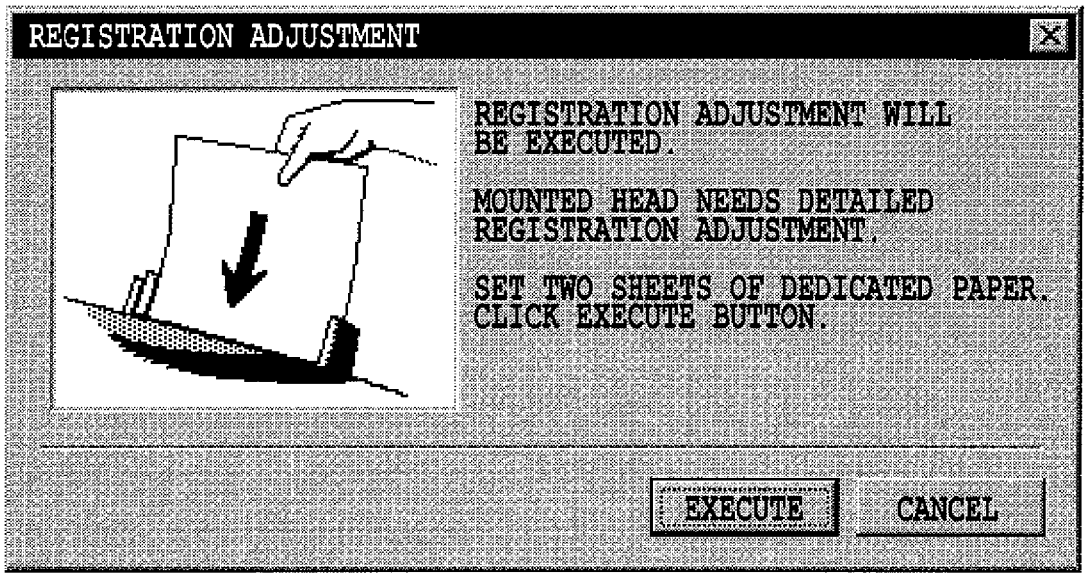
FIG. 8 is a diagram showing a display example of a detailed registration adjustment guidance in accordance with an embodiment of the present invention.
Figure 9A:
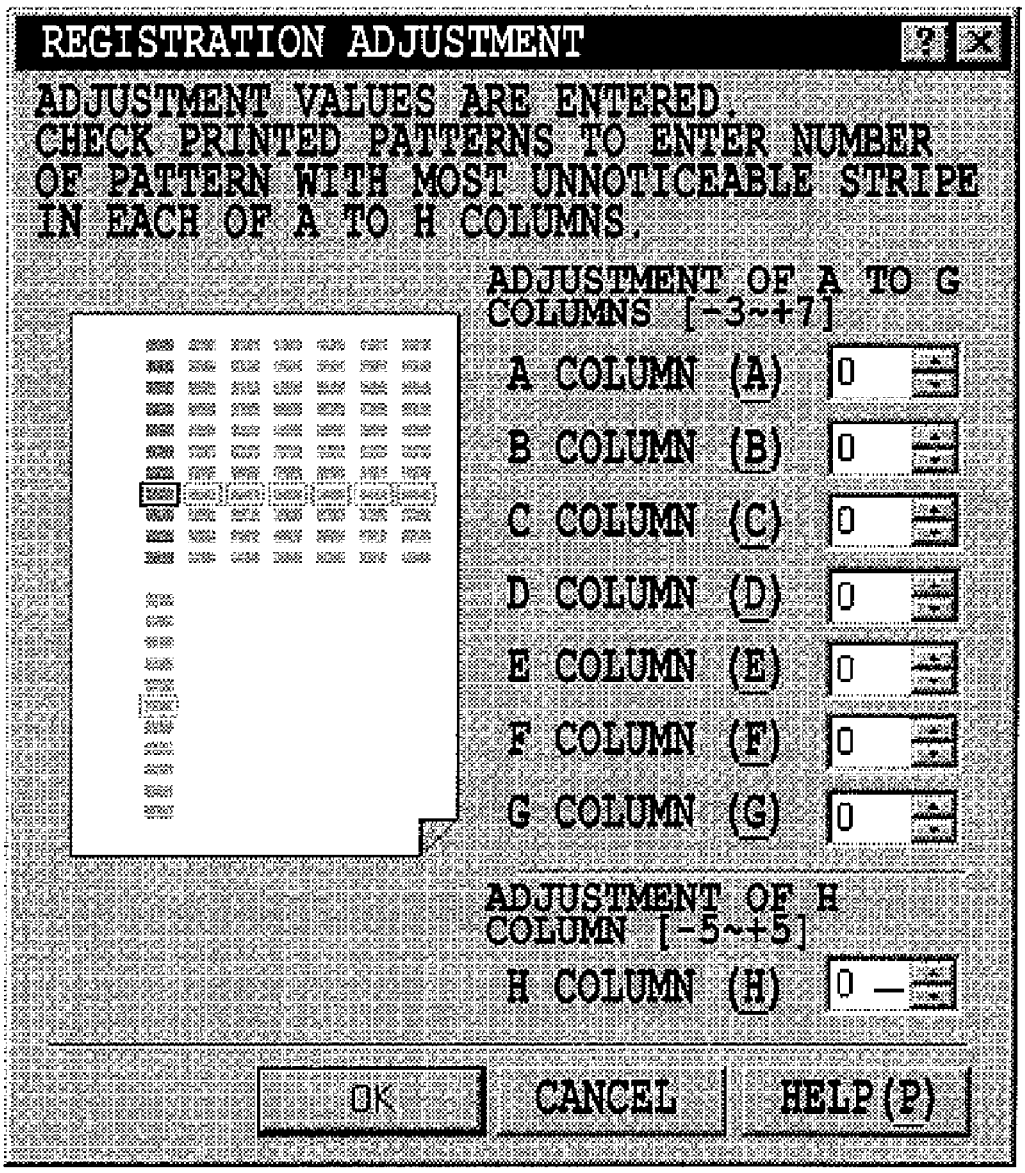
FIGS. 9A and 9B are diagrams showing display examples of adjustment value inputting screens for detailed registration adjustment in accordance with an embodiment of the present invention.
Figure 9B:
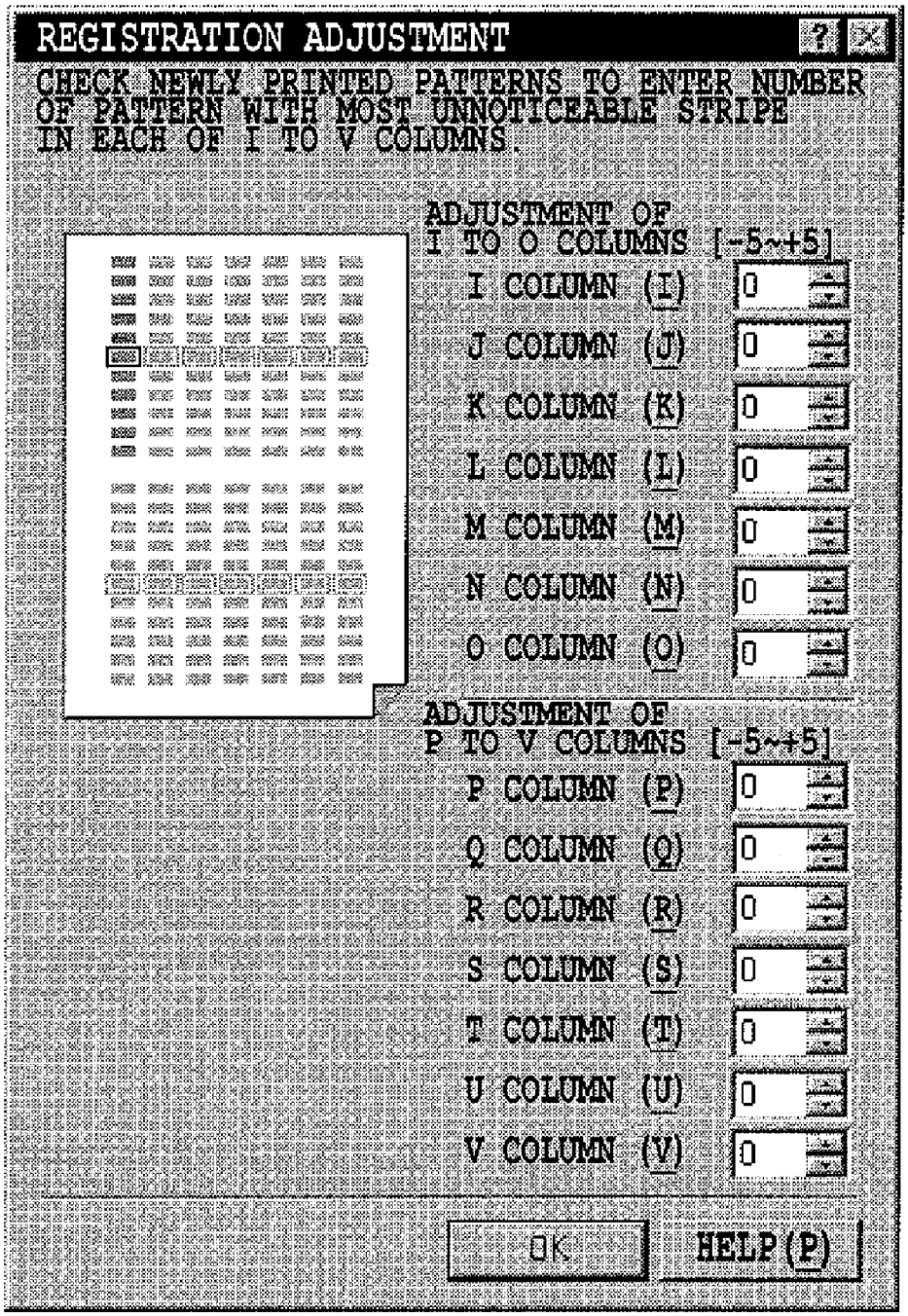

If it is determined in step 505 that the detailed registration adjustment is to be executed, then in step 510, a guidance screen is displayed to show the type and number of sheets required for the detailed registration adjustment, as shown in FIG. 8. When the user instructs the execution of the detailed registration adjustment via this screen, the printer driver issues a command for execution of registration adjustment to a printer in step 511 to cause the printer to print a registration adjustment pattern. Subsequently in step 512, a screen for inputting adjustment values for the printed adjustment pattern is displayed as shown in FIGS. 9A and 9B. The printer driver then accepts the adjustment values input by the user and transmits the input values to the printer. In the present embodiment, as shown in FIG. 8, the screen shows that the detailed registration adjustment requires printing on two dedicated sheets. Two adjustment value input screens for the respective printed sheets shown in FIGS. 9A and 9B are displayed to allow the inputting of adjustment values for the printing results.

The process proceeds from step 502 or 504 to step 506 when the printer status cannot be acquired for the registration adjustment. According to the embodiment of the present invention, even in this condition, the best effort is made to execute the type of registration adjustment suited for the condition of the printer. More specifically, in step 506, the printer driver refers to the history stored in the memory in the host computer and indicating the number of past instructions for registration adjustments to determine whether the simplified or detailed registration adjustment is to be executed. The history is recorded in the memory by the printer driver itself in step 513 described below, after the printer driver has been instructed to execute the registration adjustment.

If any record of executed registration adjustment is not detected, that is, if it is detected that no registration adjustment has been executed, then it is determined that the simplified registration adjustment is to be executed. That is, the print head for which any registration adjustment has been not executed means that the print head is relatively new one and therefore the simplified registration adjustment is sufficient for the print head. Then, as described above, in step 507, the printer driver displays the simplified registration adjustment guidance and also displays an adjustment value input screen in response to the user's operation.

If in step 506, any record of executed registration adjustment is detected, that is, if it is detected that the registration adjustment has been executed, then it is determined that the detailed registration adjustment is to be executed. That is, the registration adjustment having been already executed means that the print head has been used for a relatively long time, and therefore the detailed registration adjustment is desirable. Then, as described above, in step 510, the detailed registration adjustment guidance is displayed and then an adjustment value input screen is displayed.

Either registration adjustment is executed during steps 507 to 509 or steps 510 to 512. Then, in step 513, the executed registration adjustment is recorded in a storage area of the memory such as a register in the host computer, in association with the mounted print head.

As described above, according to the present embodiment, when the bidirectional communication between the printer and host computer is possible, the printer driver acquires information on the contents of the next registration adjustment to be executed, directly from the printer to enable an accurate guidance based on the contents of the registration adjustment to be executed. Further, when the printer status cannot be acquired, referring the history of the registration adjustment to be executed in accordance with an instruction from the printer driver enables the prediction of the type of the next registration adjustment to be executed in the printer. Consequently, even if the status cannot be acquired, the correct guidance and the corresponding appropriate registration adjustment can be executed.

Second Embodiment

In the first embodiment described above, the same instruction is issued when the printer is instructed to execute registration adjustment in steps 508 and 511 in FIG. 5; no distinction is made between the simplified registration adjustment and the detailed registration adjustment. In contrast, in the present embodiment, if the printer status cannot be acquired, the printer driver explicitly instructs the execution of the simplified registration adjustment or detailed registration adjustment.

Figure 10:
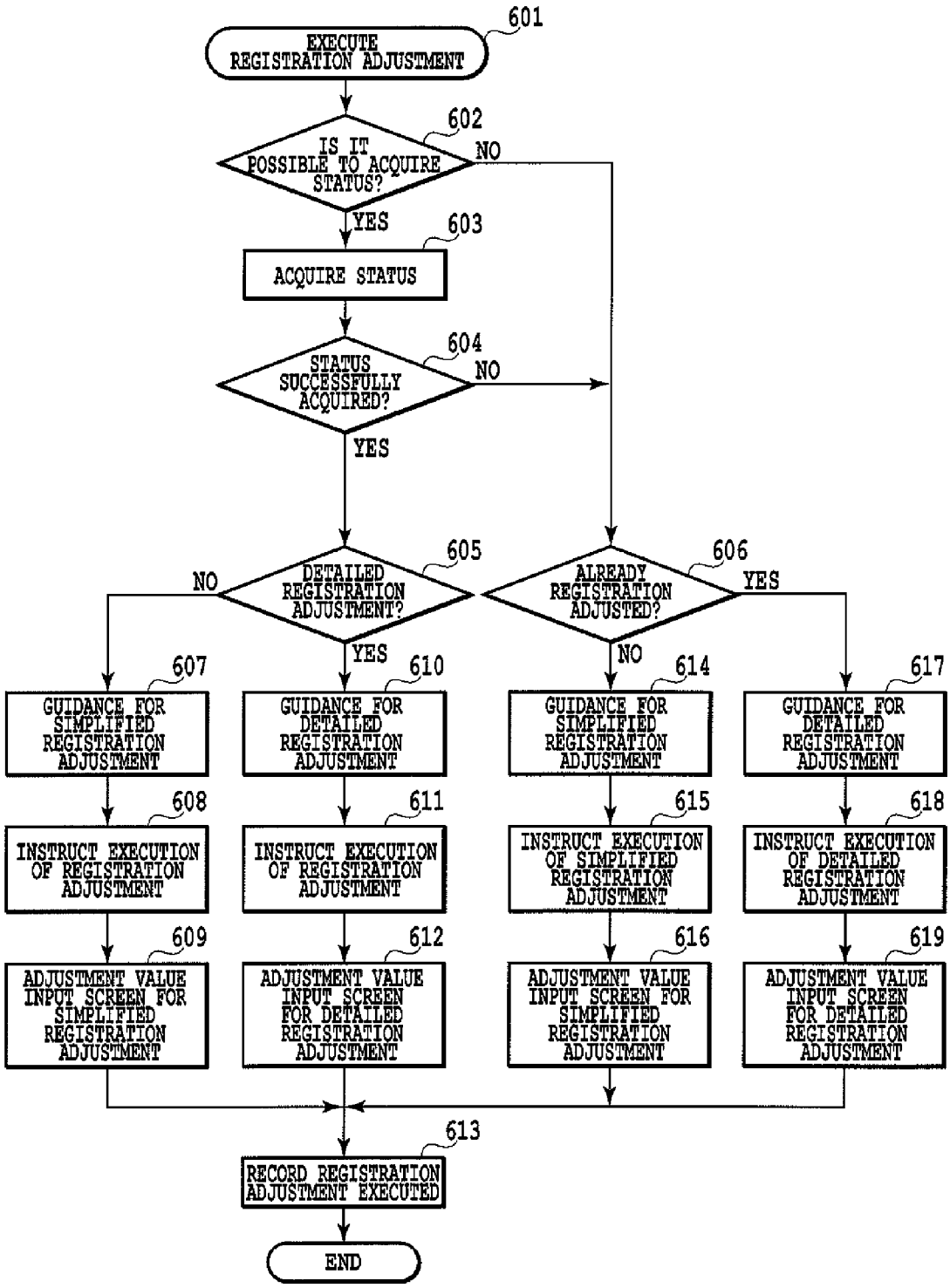
FIG. 10 is a flowchart showing a process executed by the printer driver in accordance with a second embodiment of the present invention.

FIG. 10 is a flowchart showing a process for registration adjustment executed by the printer driver in accordance with the present invention. The process executed when the printer status can be acquired is similar to that in the first embodiment.

If the status cannot be acquired, similarly to the first embodiment, it is determined in step 606 whether or not the memory in the host computer contains a record of executed registration adjustment and switches the guidance to be displayed on the basis of the determination as in the case of the first embodiment. However, in response to the user's instruction of execution of the simplified registration adjustment in step 614, the printer driver issues, in step 615, a command ordering the printer to execute the simplified registration adjustment. That is, not only the execution of registration adjustment but also the type of the registration adjustment to be executed are specified. Similarly, in response to the user's instruction of execution of the detailed registration adjustment in step 617, the printer driver issues, in step 618, a command ordering the printer to execute the detailed registration adjustment.

In response, the CPU 201 of the printer selects one of the plural registration adjustment programs stored in the ROM 202 which corresponds to the command received from the host computer. The CPU 201 then executes the simplified or detailed registration adjustment.

The execution of either registration adjustment is instructed during steps 607 to 609, steps 610 to 612, steps 614 to 616, or steps 617 to 619. Then, in step 613, the executed registration adjustment is recorded in the memory area in the host computer.

Like the first embodiment, the above embodiment enables the appropriate registration adjustment to be executed. If the status can be acquired from the printer, an accurate guidance can be provided on the basis of the contents of the registration adjustment to be executed. In addition, if the printer status cannot be acquired, the history of registration adjustment executed in response to an instruction from the printer driver is referred to determine the type of registration adjustment to be executed in the printer, and the type of the registration adjustment to be executed is explicitly specified. Thus, even if the status cannot be acquired and then it is not possible to reliably determine the type of registration adjustment to be actually executed in the printer, the appropriate guidance and instruction of execution of the registration adjustment, which does not differ from the registration adjustment that is to be actually executed, can be specified. That is, in the first embodiment, when the printer driver instructs registration adjustment, a printer refers the history of registration adjustment stored in the memory of the printer to determine the type of the registration adjustment to be executed. Thus, a difference may occur between the type of registration adjustment shown in the guidance by the printer driver and the type of registration adjustment actually executed in the printer. However, the present embodiment can eliminate this case.

Third Embodiment

Figure 11:
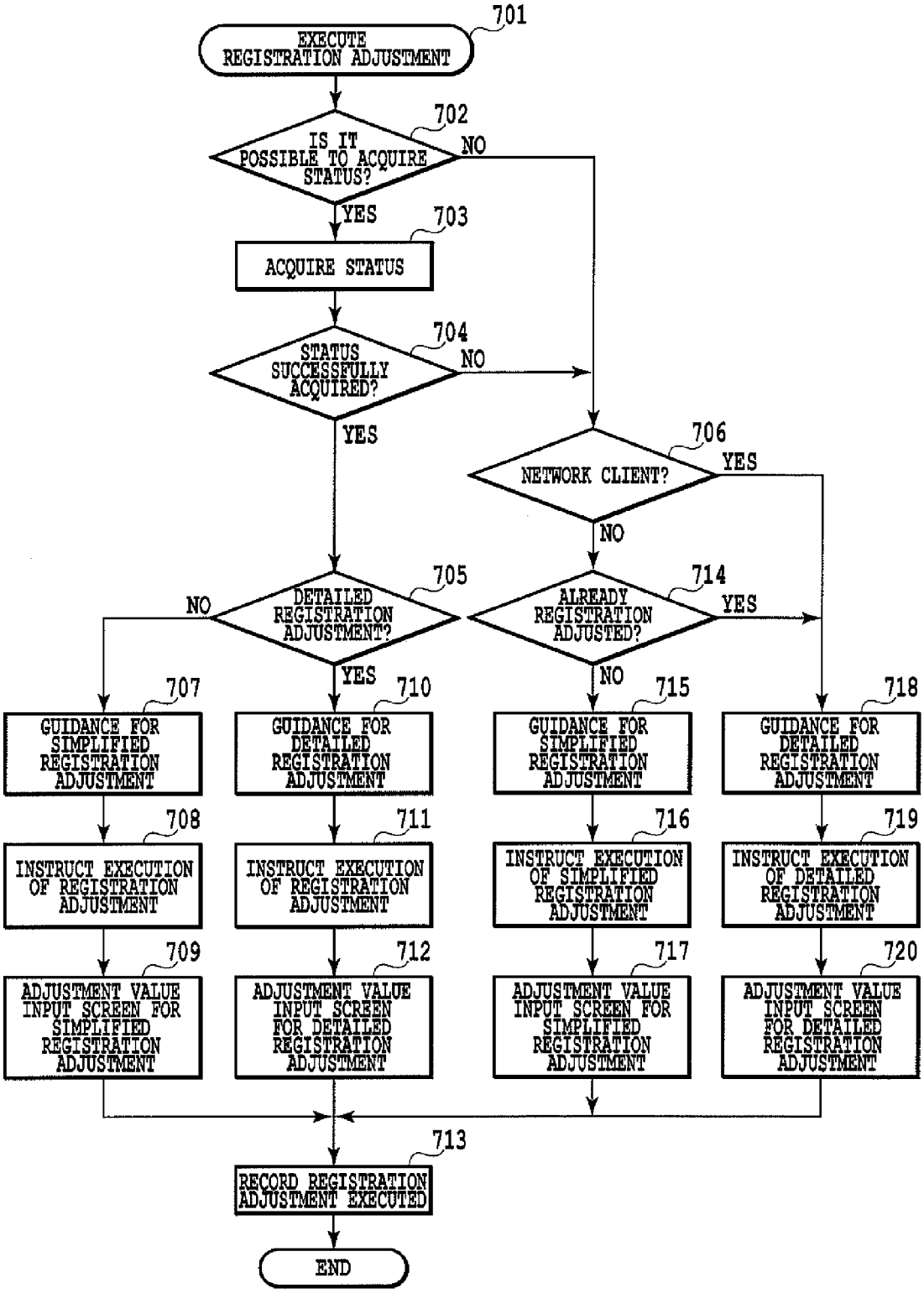
FIG. 11 is a flowchart showing a process executed by the printer driver in accordance with a third embodiment of the present invention.

The present embodiment relates to registration adjustment in a system having a network of a plurality of PCs. FIG. 11 is a flowchart showing a process for registration adjustment executed by the printer driver in accordance with the present embodiment.

The process executed when the host computer can acquire the printer status in accordance with the present embodiment is the same as that executed in the same case in accordance with the first and second embodiments. However, when the status cannot be acquired, then first, determination is made in step 706 as to whether or not the printer driver, which executes the present process, is installed in the PC (a print server; the PC holds the history of registration adjustment held in its memory) to which the printer is connected. When the printer driver is installed in the print server, a process similar to that in the second embodiment is executed. In contrast, in step 706, when it is determined that the PC (client) in which the printer driver is installed is not the PC to which the printer is connected, it is presumed that the registration adjustment has been executed. Then, the detailed registration adjustment is executed (steps 718-720).

In this case, the client may refer the history of registration adjustment in the print server. However, performing a read or write operation on a remote computer is often difficult for a security reason. Further, the client computer may hold the history to be referred. However, the first registration adjustment will be the simplified type for a plurality of client computers. This may increase the possibility of preventing the execution of the required registration adjustment. Consequently, whenever the status cannot be acquired, the registration adjustment executed from the client computer is limited to the detailed version uniformly. This may degrade the client user's usability. However, in this case, priority is given to the avoidance of insufficient registration adjustment partly because maintenance operations such as registration adjustment are generally executed from the server computer.

The present embodiment not only exerts the effect described in the second embodiment but also enables the appropriate registration adjustment and its guidance without complicating the process in the network environment.

Fourth Embodiment

For example, after the printer is used or registration adjustment is executed at least once, the history stored in the memory in the host computer to which the printer is connected may be reset as a result of, for example, reinstallation of the printer driver in the host computer. Further, connecting the printer to a different computer may prevent the subsequent acquisition of the status. In this case, the history-based determination of contents of registration adjustment to be executed is incorrect. In contrast, when the status can be acquired, the present embodiment corrects the history to be recorded in the host computer on the basis of the status acquired by the printer driver.

Specifically, for example, if the status is successfully acquired in step 704 in the flowchart in FIG. 11 for the third embodiment, the history of executed registration adjustment in the host computer is updated in accordance with the status. In this case, the history may be unconditionally overwritten or may be updated in the case of inconsistence of histories. The update of history of executed registration adjustment is performed at any timing between step 704 and step 713. Apparently, similar control is applicable to the first and second embodiments.

The present embodiment corrects the history in the host computer in the case of successful acquisition of the status. This enables, in more cases, the accurate determination of contents of registration adjustment to be executed as well as the appropriate guidance.

Fifth Embodiment

In the example of each embodiment described above, the present invention is applied to registration adjustment. The application of the present invention is not limited to this aspect. For example, the possible cause of unwanted stripes in printed images other than the deviating registration adjustment position is ink ejection failure caused by bubbles residing in the nozzles of the print head in the printer, an increase in the viscosity of ink in the nozzles, or foreign matter such as paper dust which is attached to the print head surface. This ejection failure may cause incompletely formed dots, resulting in unwanted stripes. To prevent this, a cleaning function is provided for sucking and discharging ink from the nozzles or wiping off the foreign matter adhering to the print head surface using a wiper. In this case, the user's instruction of cleaning causes the printer to execute the corresponding process and then to print a nozzle check pattern that allows the user to visually check whether or not the ejection failure has been eliminated. Then, if any stripe is observed in the pattern, the user is generally prompted to instruct the cleaning process again.

It is complicated for the user to appropriately use all of the registration adjustment function and plural stripe reduction functions. Thus, for example, only one "stripe reduction" function is provided so that the user's execution of this function results in the provision of guidance for operations for the registration adjustment and the execution of the appropriate registration adjustment if no registration adjustment has been carried out prior to that time. On the other hand, if the registration adjustment has already been executed, guidance for operations for cleaning or nozzle check pattern printing is provided, and cleaning and nozzle check pattern printing are executed.

The present embodiment enables the provision of the appropriate stripe reduction process and its guidance. Moreover, the present invention is applicable not only to registration adjustment but also to any other maintenance processes.

Sixth Embodiment

In the above description, the detailed registration adjustment is executed for all the nozzles for all the ink colors. However, of course, the application of the present invention is not limited to this aspect. In particular, the detailed and simplified registration adjustments may have relative levels of adjustments and involve respective required adjustments. As described in the fifth embodiment, the present invention is applicable to the form in which in the case of two types of adjustments, the next adjustment to be executed is determined on the basis of whether or not one of the adjustments has already been carried out.

The present invention allows the provision of the appropriate guidance and the execution of the required adjustment for a maintenance process the contents of which vary depending on the number of times that the process has been executed. In the example in each of the above embodiments, the contents of the maintenance process vary depending on whether or not guidance and execution of the maintenance are provided to the user that is the basis for the determination. The basis may be plural times of provision of the guidance and execution of the maintenance, or instead of number of maintenances (adjustments), the number of normal printing operations may be the basis.

Further, the present invention deals with both cases where the status can be acquired and where the status cannot be acquired. Thus, the present invention is directly applicable to cost-reduced low end printers for which counting of number of times that the printer has been used, identification of the print head, or returning of the status itself is difficult to achieve. Thus, the same integral maintenance utility may be provided for both printers that can return the status and printers that cannot return the status. This is useful for reducing the provision costs of software.

Moreover, for each of the above embodiments, it is assumed that the status is acquired from the printer so that maintenance is executed on the basis of the status. However, the present invention is not limited to this. In a simplified configuration, the same maintenance process may be executed on the basis of the history of registration adjustment or the like provided in the host apparatus. Further, each of the above embodiments controllably determines which of two maintenance operations such as the detailed and simplified registration adjustments is to be performed. However, the present invention is not limited to this configuration. The present invention is also applicable to a configuration that performs one of at least three maintenance operations of different levels or types depending on the number of registration adjustments executed.

Other Embodiments

In above described embodiments, a host computer acquires a status from a printer and makes determination based on the acquired status to switch maintenance processes. However, the application of the present invention is not limited to this aspect. The present invention may include an aspect in which plural maintenance processes different in levels of adjustments, such as the detailed registration adjustment and the simplified registration adjustment, are selected to be executed at respective independent timings and selection of the maintenance process from the plural maintenance processes is left to an user.

Further Embodiments

The present invention is put into practice by executing program codes of software such as those shown in FIGS. 5, 10 and 11, for example, which implements the functions of the above described embodiments, or by a storage medium storing such program codes. Further, the present invention is also put into practice by that the computer (CPU or MPU) of the system or apparatus reads the program codes to execute them. In this case, the program codes of the software themselves implement the functions of the above described embodiments, so that the storage medium storing the program codes constitute the present invention.

The storage medium storing such program codes may be, for example, a floppy disk, a hard disk, an optical disk, a magneto-optical disk, a CD-ROM, a magnetic tape, a non-volatile memory card, or a ROM.

In addition, if the functions of the above described embodiments are implemented not only by the computer by executing the supplied program codes but also through cooperation between the program codes and an OS (Operating System) running in the computer, another application software, or the like, then these program codes are of course embraced in the embodiments of the present invention.

Furthermore, a case is of course embraced in the present invention, where after the supplied program codes have been stored in a memory provided in an expanded board in the computer or an expanded unit connected to the computer, a CPU or the like provided in the expanded board or expanded unit executes part or all of the actual process based on instructions in the program codes, thereby implementing the functions of the above described embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-043158, filed Feb. 20, 2006, which is hereby incorporated by reference herein in its entirety.

What is claimed is:

1. A print control system capable of executing one of a plurality of maintenances for a printing apparatus, which have different maintenance levels and include at least a maintenance related to an adjustment of print positions by a print head in the printing apparatus, in accordance with information on an amount of a predetermined operation in the printing apparatus, the information being held by an information processing apparatus or a printing apparatus, said system comprising:

holding means for holding the information on an amount of the predetermined operation, said holding means being located in the information processing apparatus or in the printing apparatus;

a user interface;

acquiring means for acquiring the information on an amount of the predetermined operation from said holding means; and means for showing guidance for executing one of the plurality of maintenances on said user interface, based on the acquired information on an amount of the predetermined operation, wherein each of the plurality of maintenances is the maintenance related to the adjustment of print positions by a print head in the printing apparatus, and wherein the amount of the predetermined operation is a number of adjustments of print position executed in the printing apparatus.

2. A print control system as claimed in claim 1, wherein said acquiring means has determination means for determining whether or not status information corresponding to the information on the amount of the predetermined operation can be acquired from the printing apparatus, and, when said determination means determines that the status information can not be acquired, acquires the information on the amount of the predetermined operation from said holding means located in the information processing apparatus.

3. A print control system as claimed in claim 1, wherein said acquiring means has determination means for determining whether or not status information corresponding to the information on the amount of the predetermined operation can be acquired from the printing apparatus, and, when said determination means determines that the status information can be acquired, acquires the status information to replace status information, which is the information on the amount of the predetermined operation and held in said holding means located in the information processing apparatus, with the acquired status information.

4. A print control system as claimed in claim 1, that is implemented with a plurality of host apparatuses connected to a network, wherein in a case that a host apparatus implementing a maintenance control has not said holding means, the host apparatus implementing a maintenance control instructs the printing apparatus to execute more higher level of maintenance among the plurality of maintenances when executing the maintenance.

5. An information processing apparatus causing a printing apparatus that is capable of one of a plurality of maintenances for the printing apparatus, which have different maintenance levels, to execute the maintenance, in accordance with information on an amount of a predetermined operation in the printing apparatus, the information being held by an information processing apparatus or a printing apparatus, said information processing apparatus comprising:

a user interface;

acquiring means for acquiring the information on an amount of the predetermined operation from holding means for holding the information on an amount of the predetermined operation, said holding means being located in the information processing apparatus or in the printing apparatus; and execution means for showing guidance for executing a first maintenance including at least a maintenance related to an adjustment of print positions by a print head in the printing apparatus or a second maintenance, on said user interface, based on the acquired information on an amount of the predetermined operation, and causing the printing apparatus to execute the maintenance, wherein each of the plurality of maintenances is the maintenance related to the adjustment of print positions by a print head in the printing apparatus, and the amount of the predetermined operation is a number of adjustments of print position executed in the printing apparatus.

6. An information processing apparatus as claimed in claim 5, wherein said acquiring means has determination means for determining whether or not status information corresponding to the information on the amount of the predetermined operation can be acquired from the printing apparatus, and, when said determination means determines that the status information can not be acquired, acquires the information on the amount of the predetermined operation from said holding means located in the information processing apparatus.

7. A computer readable medium for storing a program that is read by a computer to cause the computer to function as an information processing apparatus causing a printing apparatus that is capable of one of a plurality of maintenances for the printing apparatus, which have different maintenance levels and include at least a maintenance related to an adjustment of print positions by a print head in the printing apparatus, to execute the maintenance, in accordance with information on an amount of a predetermined operation in the printing apparatus, the information being held by the computer or a printing apparatus, said function comprising:

a user interface;

acquiring means for acquiring the information on an amount of the predetermined operation from holding means for holding the information on an amount of the predetermined operation, said holding means being located in the computer or in the printing apparatus; and execution means for showing guidance for executing one of the plurality of maintenances on said user interface, based on the acquired information on an amount of the predetermined operation, and causing the printing apparatus to execute the maintenance, wherein each of the plurality of maintenances is the maintenance related to the adjustment of print positions by a print head in the printing apparatus, and the amount of the predetermined operation is a number of adjustments of print position executed in the printing apparatus.

* * * * *